US008176667B2

(12) United States Patent
Kamal et al.

(10) Patent No.: US 8,176,667 B2
(45) Date of Patent: May 15, 2012

(54) FIREARM SENSING DEVICE AND METHOD

(76) Inventors: Ibrahim Kamal, Limoges (FR); Chi-Jen Wong, Oakton, VA (US)

( * ) Notice: Subject to any disclaimer, the term of this patent is extended or adjusted under 35 U.S.C. 154(b) by 313 days.

(21) Appl. No.: 12/652,076

(22) Filed: Jan. 5, 2010

(65) Prior Publication Data

US 2011/0162245 A1 Jul. 7, 2011

(51) Int. Cl.
*F41A 9/53* (2006.01)

(52) U.S. Cl. ..... 42/1.01; 42/1.02; 42/1.05; 42/71.01; 89/191.01; 89/132

(58) Field of Classification Search ..... 42/1.01, 42/1.02, 1.05, 71.01; 89/191.01, 132
See application file for complete search history.

(56) References Cited

U.S. PATENT DOCUMENTS 4,483,190 A * 11/1984 Cornett ..... 73/167
5,201,658 A * 4/1993 Taylor et al. ..... 434/18
6,256,915 B1 * 7/2001 da Silveira ..... 42/1.05
7,775,150 B2 * 8/2010 Hochstrate et al. ..... 89/193
7,802,391 B2 * 9/2010 Quinn et al. ..... 42/1.03

* cited by examiner

*Primary Examiner* — J. Woodrow Eldred
(74) *Attorney, Agent, or Firm* — The Law Office of Michael E. Kondoudis

(57) ABSTRACT

A system for resolving at least one use parameter relating to a firing of a machinegun or of a semi-automatic firearm having a receiver, an action within the receiver and that includes a piston, and a buffer tube that receives at least a portion of the piston during a cycling of the action in response to a recoil. The system includes: a display configured to display at least an indication of at least one use parameter; a sensor disposed in the buffer tube, the sensor sensing a cycling of an action via movement of the piston in the buffer tube; a processor that receives sensed data from the sensor and, based on the received sensed data, calculates the at least one use parameter, the processor causing the display to display the at least an indication; and a power source disposed in the stock or the display and energizing the sensor, the processor, and the display.

19 Claims, 8 Drawing Sheets

FIREARM SENSING DEVICE AND METHOD

BACKGROUND

1. Technical Field

The present invention relates generally to firearms and, more particularly, to systems for and methods of sensing various parameters relating to the operation of a firearm.

2. Description of Related Art

Increasingly, firearm manufacturers are adding electronics to firearms to increase utility and/or ease of use.

One example is U.S. Pat. No. 5,406,730, which is directed to an electronic ammunition counter that uses sound and recoil transducers to sense the acoustic wave that results from the discharge of a firearm.

Another example is U.S. Pat. No. 6,286,242, which is directed to a security apparatus for a firearm that uses a sensor to determine when a control signal permitting use (discharge) should be sent.

Still another example is a laser sight, in which a laser light is mounted to a firearm along the axis of the barrel to visually indicate the trajectory of fire so that a user may more easily adjust the direction of fire.

Despite the increased use of electronics in firearm design, there remain many applications and arrangements that could further increase utility and/or ease of use.

BRIEF SUMMARY

An aspect of the present invention provides a system for resolving at least one use parameter relating to a firing of a machinegun or of a semi-automatic firearm having a receiver, an action within the receiver and that includes a piston, and a buffer tube that receives at least a portion of the piston during a cycling of the action in response to a recoil. The system includes: a display configured to display at least an indication of at least one use parameter; a sensor disposed in the buffer tube, the sensor sensing a cycling of an action via movement of the piston in the buffer tube; a processor that receives sensed data from the sensor and, based on the received sensed data, calculates the at least one use parameter, the processor causing the display to display the at least an indication; and a power source disposed in the stock or the display and energizing the sensor, the processor, and the display.

Another aspect of the present invention provides a stock for a firearm of a machinegun or semi-automatic type, including: a buffer tube that is removably attached to a receiver of the firearm and dimensioned to receive a piston that travels in the buffer tube during a recoil caused by a discharge of the firearm; a sensor that is removably attached to the stock and that, when attached to the stock, extends into the baffle tube axially along a central axis thereof, the sensor sensing at least one parameter related to movement of the piston when the piston recoils into the buffer tube due to a discharge of the firearm; a processor that receives sensing data from the sensor and, based on the received sensing data, calculates the at least one use parameter related to the at least one parameter, the processor causing a display to display at least an indication of the calculated at least one use parameter; and a power source that is disposed in the stock and energizes the sensor and the processor.

Still another aspect of the present invention provides a method of using a sensor located in a buffer tube of a machinegun or of a semi-automatic firearm to measure various parameters relating to the discharge of the firearm. The method includes: sensing movement of a piston of the firearm in response to a cycling of the action of the firearm, via a sensor disposed along a central, longitudinal axis of the buffer tube and of travel of the piston during recoil; transferring the sensed information to a processing module; transforming, via the processing module, the transferred information into use information; and displaying the use information to the user of the firearm.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of one or more embodiments thereof made in conjunction with the accompanying illustrative drawings of which.

DETAILED DESCRIPTION

Figure 1:
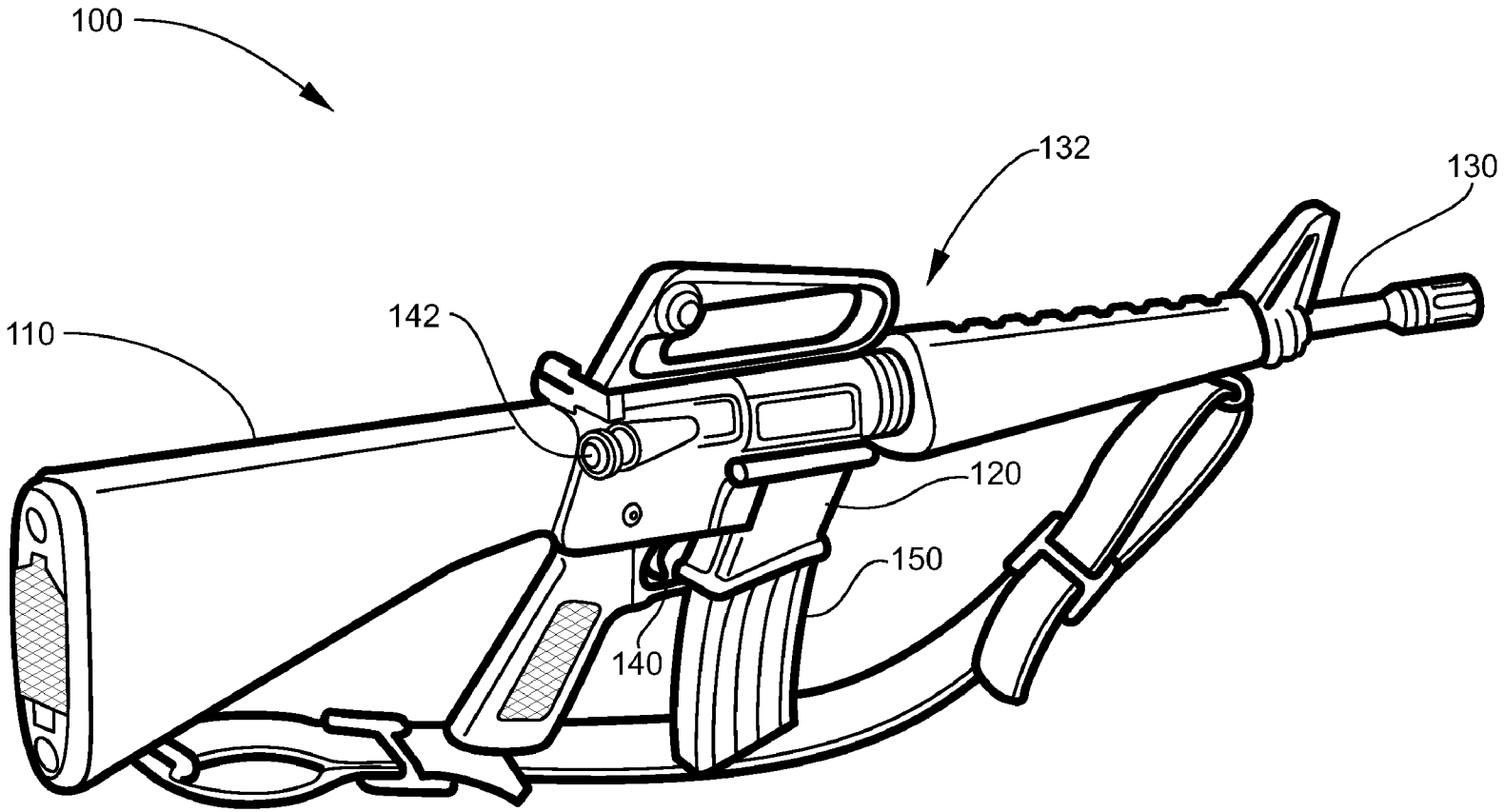
FIG. 1. is a perspective view of a firearm with which one or more embodiments of the present invention is/are usable.

Reference will now be made in detail to one or more embodiments of the present invention, examples of which are illustrated in the accompanying drawings, wherein like reference numerals refer to the like elements throughout. The one or more embodiments are described below to explain the present invention by referring to the figures.

As used herein, the term machinegun means a firearm as defined by 27 CFR 478.11 and 26 U.S.C. §5845(b).

Generally, a machinegun is a firearm that fires a round from a cartridge (casing), automatically extracts the used cartridge and ejects it, then loads a new cartridge; generally by harnessing the recoil energy resulting from the detonation of the cartridge. A defining characteristic of a machinegun is that it will continue to load and fire ammunition until the trigger (or other activating device) is released or until the ammunition is exhausted.

As used herein, the term semi-automatic firearm means a firearm that uses the aforementioned process to automatically load and eject a cartridge, but will not continue to load and fire ammunition until a trigger or other activating device is released.

Referring to the drawings, and more particularly to FIG. 1, there is shown a firearm (rifle) 100 with which one or more embodiments of the present invention are usable. One or more embodiments may be used with firearm simulators such as an Airsoft® gas blowback rifle as well.

The firearm 100 may be a machinegun or a semiautomatic firearm. Non-limiting examples of the firearm include an M16 rifle and an AR-15 rifle. The illustrated firearm 100 includes the following main components: a stock 110; a receiver 120; a barrel 130; a trigger assembly 140, and a buffer arrangement in the stock 110 (shown in FIG. 2).

The receiver 120 serves as the main body or frame of the firearm and is the central component to which other main components are attached. The receiver 120 receives the barrel 130 at a forward end and the trigger assembly 140 at a bottom side. Also, the receiver may be configured as illustrated in FIG. 1 to receive, at a bottom side, an ammunition magazine 150 in which cartridges (ammunition) are retained.

The barrel 130 includes a chamber 132 at the end near the receiver 120. The chamber 132 supports (retains) a cartridge when it is brought into the firing position.

The receiver 120 includes an internal piston (buffer) 212 (illustrated in FIG. 2) that constrains the cartridge in such a way as to retrain some of the high-pressure gases generated when the firearm 100 is fired. This allows beneficial use of the pressure as will be explained in more detail below. The piston 212 may ride on a carrier (not illustrated), which may include, for example, rails, rods, or recesses in the receiver. The piston 212 includes a collar 214 (illustrated in FIG. 2) that engages a spring 216 (illustrated in FIG. 2), as is explained in detail below.

The trigger 140 is the user interface to the firing assembly of the firearm 100. It can be activated by finger pressure, or it can be an electro-mechanical device activated by finger pressure.

Figure 2:
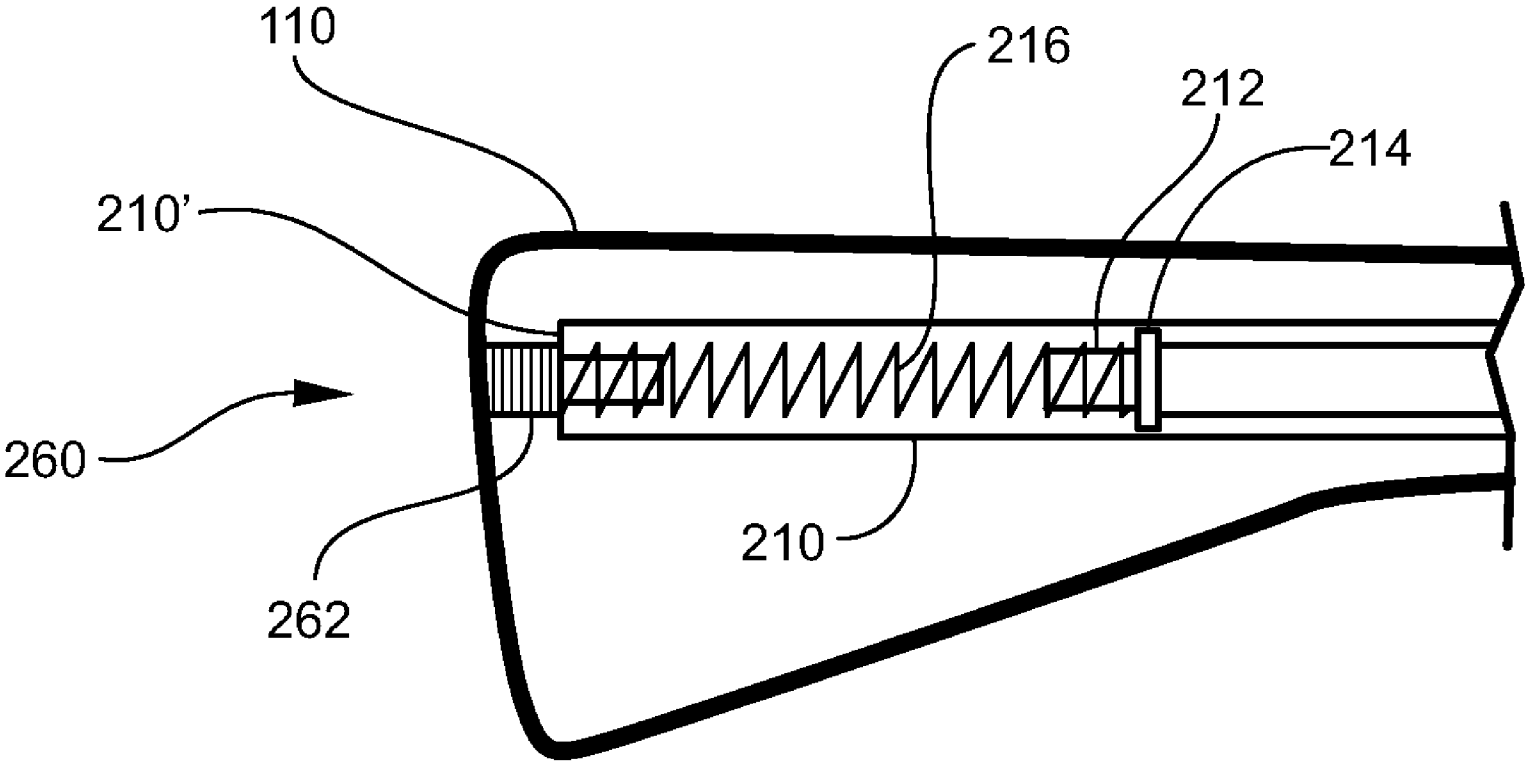
FIG. 2. is a side elevational view of a stock usable with the firearm of FIG. 1 and that is consistent with an embodiment of the present invention.

Referring to FIG. 2, the buffer arrangement includes a buffer tube 210 is received by the receiver 120 in such a manner as to accept the piston 212 and carrier during recoil thereof, as is explained below.

The spring 216 is disposed in the buffer tube 210, the spring 216 extends from the back wall 210' of the buffer tube 210 (the wall distal from the receiver 120) to the collar 214. The spring 216 provides a resilient, restorative force to the piston 212 during the latter part of a recoil operation, which is explained below. Briefly, as the piston 212 travels into the buffer tube 210, the spring 216 is compressed between the back wall 210' of the buffer tube 210 and the collar 214. This compression translates kinetic energy of the recoiling piston 216 into increasing potential energy of the spring 216 as the spring deforms from its rest condition. This potential energy is translated to back to kinetic energy when the resilient force of the compressed spring 216 overcomes the force of the recoiling piston 212 and pushes the piston and carrier back after each discharge of the firearm, as is explained in detail below.

The buffer tube 210 includes a sensor mount 218 that extends through the rear wall 210'. Optionally, as illustrated in FIG. 2, the mount 218 may be threaded to threadedly receive and retain a sensor, the function of which is explained below. Threaded reception is particularly advantageous in that it provides for convention replacement of the sensor and prevents debris from entering the buffer tube 210 through the mount 218. Additionally and/or alternatively, the mount 218 may receive and retain the sensor in any number of other ways, such as by friction and adhesion, for example.

The stock 110 surrounds a buffer tube 210, which is received by the receiver 120 at a rearward side thereof. The stock 110 is supported by (rides) on the buffer tube 210. The stock 110 facilitates aiming and control of the firearm 100.

As is known in the art, the receiver 120 and all of the operating parts that participate in the discharging (firing) of a firearm, including the piston, comprise "the action".

As is known in the art, machineguns and semi-automatic firearms use recoil to automatically eject cartridges (not illustrated) from and to feed (load) cartridges into the chamber. This operation uses recoil, blowback, or a mechanical device (e.g., a gas piston) to harness some of the energy of the cartridge to provide the energy necessary to cycle the action. In more detail, when the eject of a firearm (the projectile(s), propellant gas, etc.) is accelerated down the barrel, a portion of the action (including the piston) is urged to move in the opposite direction, in accordance with Newton's third law of motion concerning the conservation of momentum, by the expanding gases. Thus, the momentum of the recoil can be quantified according to the following formulae:

$$\text{Momentum}=\text{mass}\times\text{velocity} \tag{1}$$

$$\text{Ejecta momentum}=\text{Recoiling momentum} \tag{2}$$

$$\text{Ejecta mass}\times\text{ejecta velocity}=\text{recoiling mass}\times\text{recoil velocity} \tag{3}$$

In operation, a firing cycle is as follows. After the trigger is activated, a hammer (not illustrated) strikes a firing pin (not illustrated) to fire a cartridge chambered in chamber 132 of the barrel 130. The firing of the cartridge causes the deflagration of the propellant. The expanding gas from this deflagration applies a force on the bullet part of the cartridge causing the bullet to travel outwardly through the barrel 130 (discharge). During discharge, some of the expanding gas is diverted through a gas port (not illustrated) to act upon the piston 212, causing the piston to recoil rearward in a direction opposite the exiting bullet and toward the rear wall 210'. The rearward motion of the piston causes the ejection of the spent cartridge and the subsequent chambering of a new cartridge. To make space for this cycling action, the recoiling piston 212 and carrier travel into the buffer tube 210. As they travel into the buffer tube 210, the piston 212 and carrier compress the spring 216 in the buffer tube, increasing the resilient force the spring applies to the recoiling piston. When the resilient force of the spring 216 exceeds the recoil force of the piston 212 due to the applied expanding gas, the piston 212 and carrier are pushed back toward the receiver 120 so that the piston will constrain another loaded cartridge in preparation for firing.

As is known in the art, machineguns and semi-automatic firearms require manually cycling of the action to load (chamber) the first cartridge. In more detail, in the absence of recoil from a prior discharge, the cycling action to load the first cartridge must be manually supplied. To permit manual cycling, the firearm 100 typically includes a charging lever 142 that permits the user to manually retract the piston 212 and carrier into the buffer tube 210. The force necessary to load or "charge" a firearm is typically about equal to the energy harnesses to operate the firearm (i.e., to fire, eject, and reload semi-automatically or automatically).

System

Figure 3:
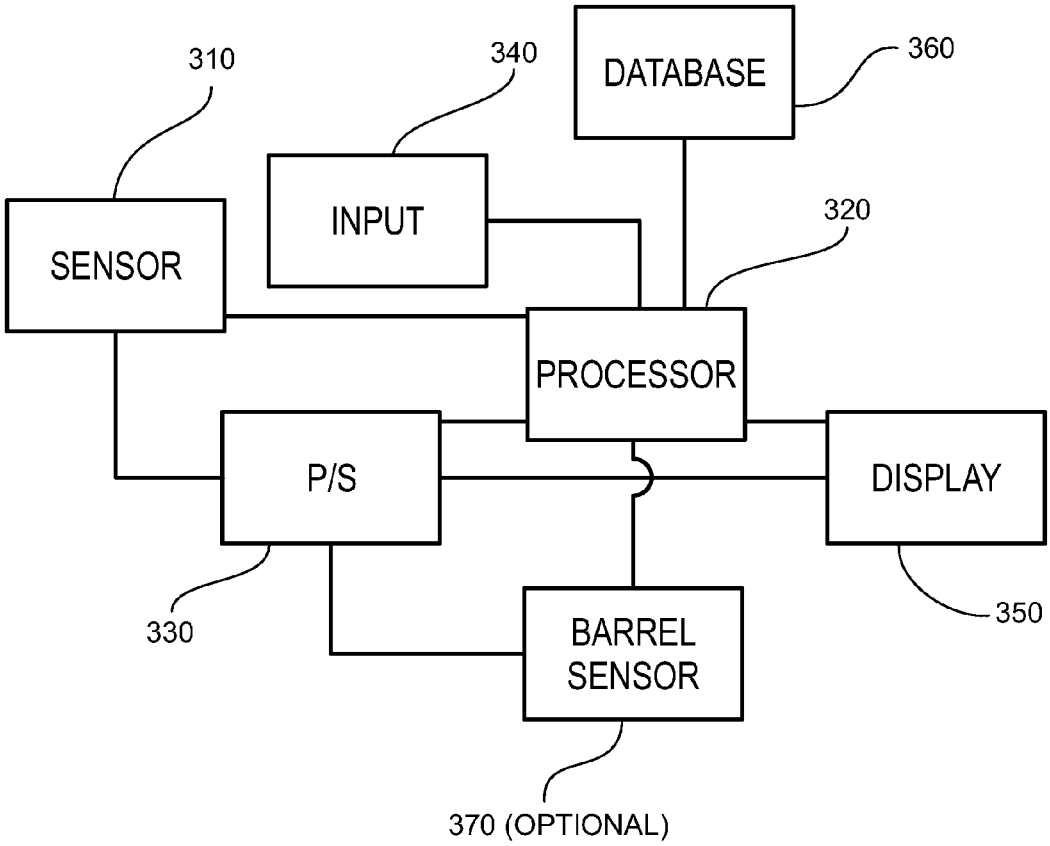
FIG. 3. is a block diagram of a system for measuring various parameters related to the use of a firearm consistent with an embodiment of the present invention.

Referring now to FIG. 3, there is illustrated a block diagram of a sensing system 300 consistent with an embodiment of the present invention. In the description of the system 300 that follows, concurrent reference is made to FIGS. 1 and 2, for efficiency, ease of explanation, and to facilitate understanding of the system only. It is to be understood that application and use of the system 300 is not limited to the firearm 100 of FIGS. 1 and 2. Rather, the system 300 is usable with other machineguns or semi-automatic firearms.

The system 300 includes: a buffer tube sensor 310; a processor 320, and a power source 330. Additionally and/or optionally, the system 300 may include an input section 340; a display 350; and/or a memory 360, operatively connected to the processor 320.

The sensor 310 is disposed in the baffle tube 210 at the rear wall thereof 210' by the mount 218 as illustrated in FIG. 2. The sensor 310, when in this received, threaded condition, extends along the longitudinal axis into the spring 216 so as not to interfere with the operation (compression and expansion) of the spring during a cycling of the action. Thus, the sensor 310 has a diameter that is less than the inner diameter of the spring 216. Also, so as not to interfere with the cycling of the action, the length of the sensor is selected so that the piston 212 will not contact the sensor during a cycling of the action. Still further, this arrangement of the sensor 310 in the spring 216 advantageously permits the sensor to be aimed directly at the piston 212, which tends to increase the accuracy of measurements taken by the sensor 310.

The sensor 310 is adapted to measure the speed and position of the buffer in the buffer tube of the firearm 100 including, by way of non-limiting examples, each recoil of the piston, each use of the charging lever 142, and the speed of the piston 212 during a cycling of the action. These measured parameters are, in turn, usable to compute various operational parameters associated with the firing (discharge) of the firearm 100 such as, for example, whether maintenance may be required, and how much ammunition may be remaining in a magazine. Further, the sensor 310 may sense information about multiple parameters, simultaneously or discretely.

Non-limiting examples of the buffer tube sensor 310 are discussed.

A first example of the sensor 310 is an optical sensor, such as a photoelectric sensor that is of the laser or infrared type. Such a sensor is located in the buffer tube along the axis along which the piston travels during a cycling of the action. Further, the optical sensor may be a high-speed optical sensor.

Figure 4A:
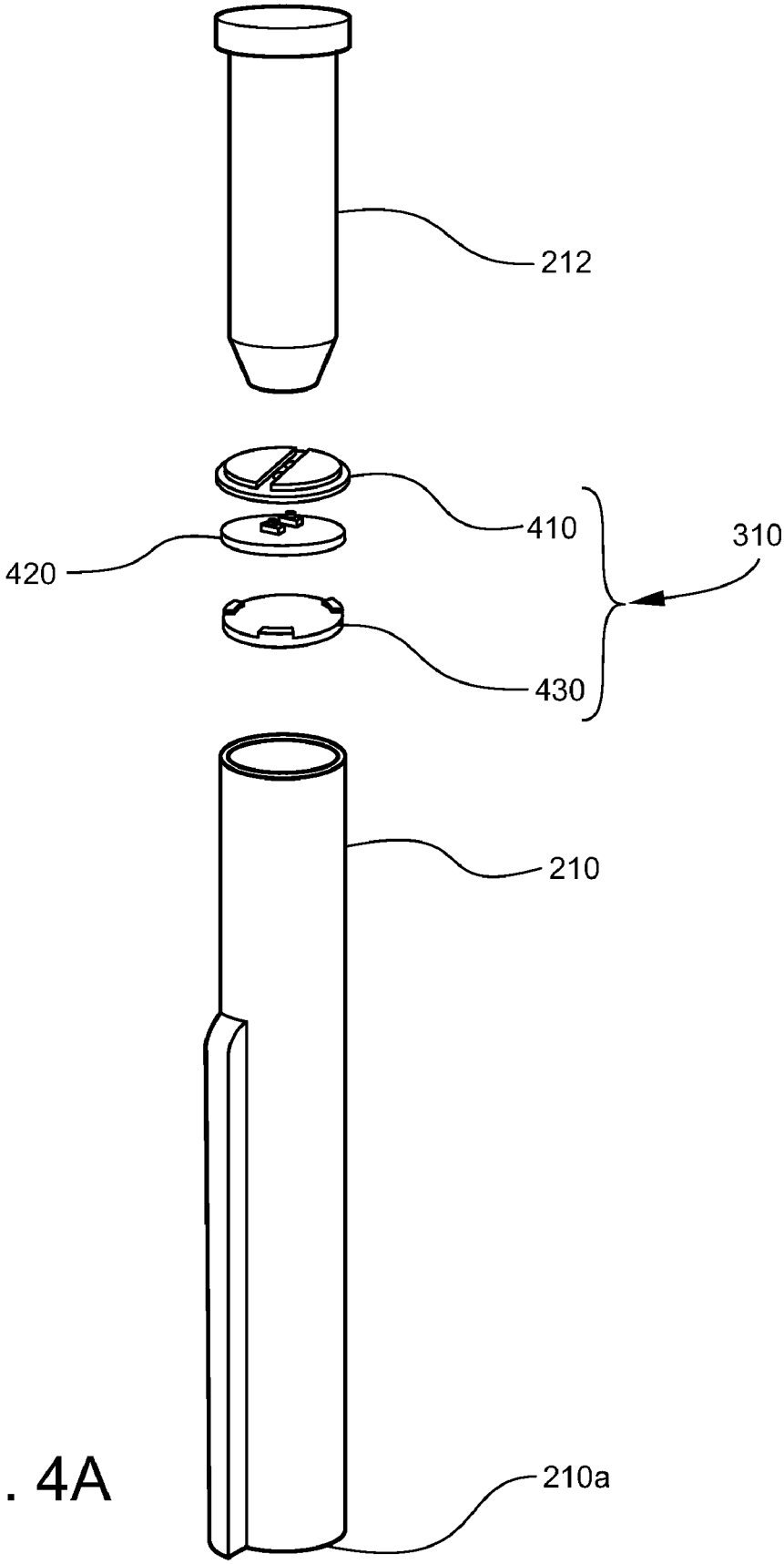
FIGS. 4A-4C are exploded views of an example of an optical variant of the buffer sensor usable in the system of FIG. 3.
Figure 4B:
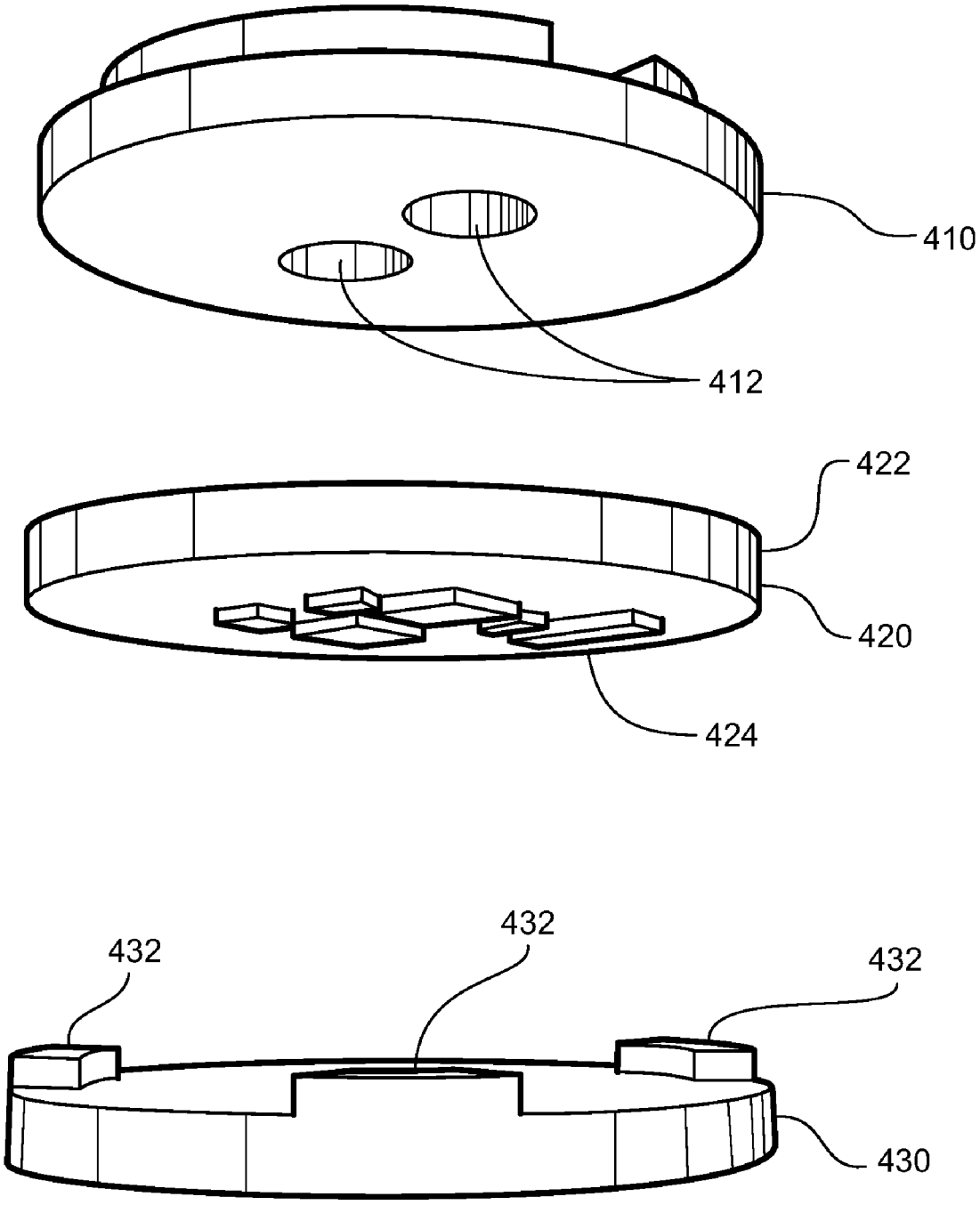
Figure 4C:
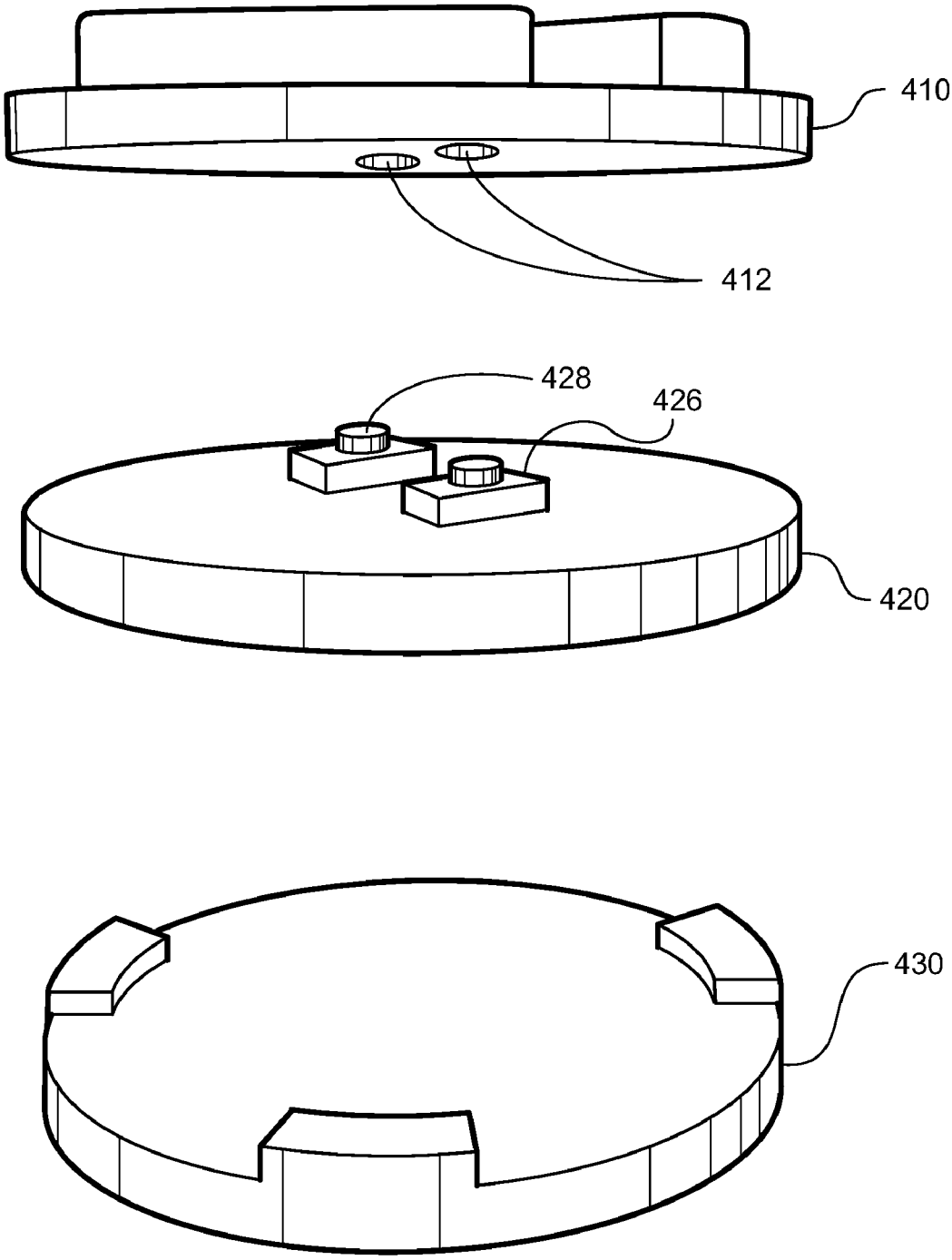

Referring to FIGS. 4A-4C, there is illustrated an exploded view of an example of the buffer tube sensor 310 of the optical type that is usable with the system 300 of FIG. 3.

In this example, the buffer tube sensor is an assembly that includes, a sensor bumper 410, an optical sender and receiver 420, and a sensor stabilizer and mount 430. The assembly fits into the buffer tube 210 at a rear end 210*a* thereof.

In FIGS. 4A-4C, the spring 216 has been removed for enhanced clarity.

The sensor bumper 410 protects optical sender 420 from the shock and heat of the buffer tube. Additionally, the sensor bumper 410 serves as a baffle or blinder to reduce errant signals for the optical sender and receiver. The sensor bumper 410 includes two through holes 412 located so that signals from the optical sender 420 may pass.

The optical sender and receiver 420 is mounted on a PCB board 422 with a signal processing chip 424. The optical sender and receiver 420 includes an optical sender 426 and an optical receiver 428, which are arranged to align with the through holes 412 of the sensor bumper 410. Portions of the optical sender and receiver 420 may extend into the through holes 412 when the sensor is in an assembled condition.

The sensor stabilizer and mount 430 absorbs heat and/or shocks and keeps the optical sensor aligned with the buffer. It may mount the optical sensor to the buffer tube by spring pressure alone. The sensor stabilizer and mount 430 includes protrusions 432 on which the optical sender and receiver 420 rests so as to substantially separate the two components.

The sensor bumper 410 and the optical sensor stabilizer may be constructed of any material that is strong, rigid, heat absorbing and light absorbing. The inventors have discovered that a high-strength polymer that may be CNC machined from a solid plastic stock to be particularly advantageous.

The illustrated, non-limiting example of FIGS. 4*a*-4*c* is advantageously and quickly removable for inspection/cleaning.

Another example of the sensor 310 is a magnetic proximity sensor that measures the distance of the piston 210 from the sensor 310.

Still another example of the sensor 310 is a compression load cell or tension gauge arrangement that measures the load on the spring 216, which changes as the piston 212 travels during the cycling of the action.

Yet another example of the sensor 310 is a one or two accelerometer arrangement. In both arrangements, one accelerometer is disposed in the piston 212. In the two accelerometer arrangement, the second accelerometer is disposed outside of the buffer tube 210. In operation, a difference in acceleration between the accelerometer(s) is the net acceleration of the piston 212.

A further example of the sensor 310 is an array of metal detector coils disposed outside of the buffer tube 210.

Another example of the sensor 310 includes a magnetic sensor that employs the Hall effect. A magnetic (Hall effect) sensor varies an output voltage in response to changes in a magnetic field resulting from travel of the piston 212 during a cycling of the action.

Still another example of the sensor 310 is a LAZER array, which is an array of optical emitters and opposing receives disposed along the path of piston travel in the buffer tube 210.

The processor 320 may be a microprocessor and constitutes a processing module. The microprocessor 320 receives information from sensor 310 and, based on the received information, computes various parameters relating to the discharge of the firearm 100.

The processor 320 may also serve as a central control for the system 300, controlling the functions of various other ones or all of the other components. For example, the microprocessor 320 may cause various information, including at least some of the computed discharge parameters, to be displayed on display 350.

The power source 330 is operatively connected to the sensor 310, the processing section 320, and the optional display 350, when present. The power source 330 may also energize other components as desired. One example of the power source 330 is a battery.

The input section 340 receives input(s) from the user and enables delivery of such inputs to the processor 320. The received input(s) may be used to more accurately calculate various parameters relating to the discharge of the firearm. Non-limiting examples of the various inputs may include selection of the number of rounds in a magazine (magazine size), the specific cartridges to be fired and/or the weight and type of bullet of rounds to be fired. With such information, the processor 320 may, for example, more accurately calculate a number of rounds remaining in a magazine. Also, with information such as the specific cartridge to be fired, the processor 320 may more accurately calculate a stopping force, for example. Non-limiting examples of the input section may include a button and a keypad.

The display 350 is operatively connected to the processor and may display various information related to the operation of the firearm. Non-limiting examples of the display 350 include LCD and LED devices. Also, the display may be incorporated into a holographic site. Optionally, the display 350 may be under control of the processor 320.

The display 350 may be controlled to display an indication of a use parameter related to the use of the firearm 100. For example, when the indication is that servicing of the firearm is due, a colored spot might be displayed or an LED illuminated.

The optional memory 360 may be used to store sensed and/or processed data for use by the processor 320 or for display by the display 350. Additionally and/or optionally, information in the memory 360 may be downloaded to a remote device.

Additionally and/or alternatively, the system may include a barrel sensor 370 to sense when a round exits the barrel. With such information, a time from firing to discharge can be measured, and a stopping force can be derived, as explained in detail below. A non-limiting example of the barrel sensor includes a temperature sensor that senses the increase in temperature in the barrel resulting from a firing of a firearm.

All of components 310-360 may be disposed in the stock 110 (FIG. 2) of the firearm 100. Such disposition is efficient from both a manufacturing and a use perspective. Advantages of this optional arrangement include: the ability to house all or many of the components of the system in a replaceable stock. Such a replaceable stock, since it would house the components, would also provide increased durability, reliability, and convenience, since the system could be replaced as a single easy to handle unit.

Optionally, one or more of the components of system 300 may be disposed on the receiver 120. For example, in some applications, it may be desirable to dispose the display 350 on the receiver 120 near a gun sight (not illustrated). Advantages of locating the display 350 on the receiver include: increased utility (easy to see display during use)

Optionally, the processor 320 may be remotely disposed on, by way of non-limiting example, on the user. In such a configuration, the operative connections between the processor 320 and the sensor 310, the input section 340, the display 350, and the memory 360 may be achieved using a wireless communication arrangement. Additionally and/or alternatively, the memory 360 may also be remotely disposed. When any component powered by the power source 330 is remotely disposed, it is powered by another power source (not illustrated).

Optionally, the input may be a plug to which a remote keypad/keyboard (not illustrated) is connectable.

Additionally and optionally, the system may include a reset button to reset any counter function of the system 300. Such a reset may be used after a magazine is replaced or after service, for example, is performed on the firearm.

Optionally, the system 300 may be arranged so that activation of the charging lever 142 may send information usable by the processor 320, including information that indicates a processor reset. As explained above, the charging lever pulls the piston 212 back manually and strip the first bullet off the magazine. This operation can be used by the processor 320. For example, if a user pulls the lever 142 back 20% (not far enough to strip another round or lock the bolt back) and holds it there for 1 second, a progress bar may appear on the display. Thereafter, if the lever is held back until the status bar finishes, it will issue a specified signal to the processor. If, however, the user releases the lever 142 before the bar finishes, the signal will not be sent. This signal may be, by way of a non-limiting example, to reset the processor 320.

Method

Figure 5:
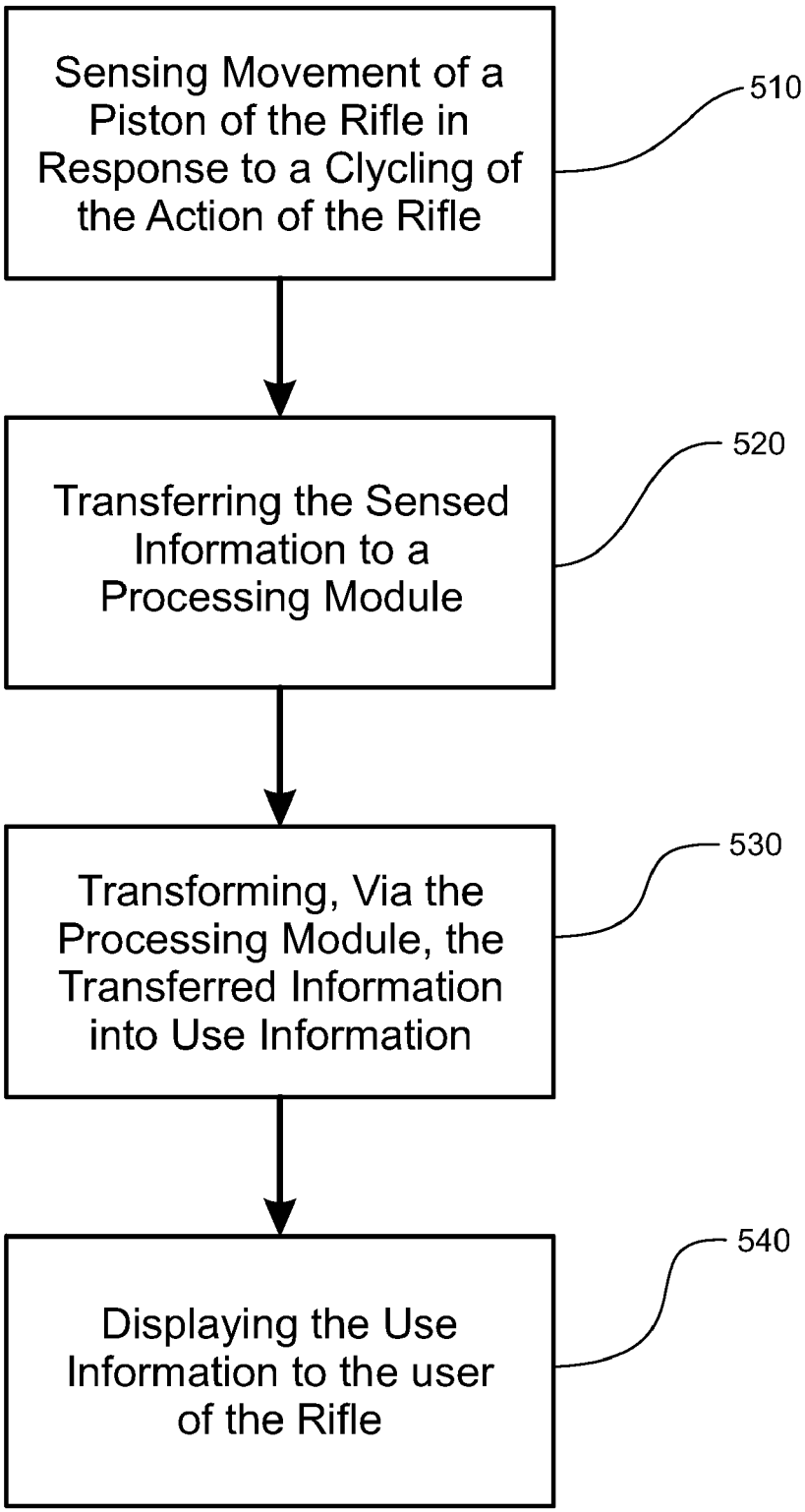
FIG. 5 is a flowchart of a method of using a sensor in a buffer tube to measure various parameters related to the use of a firearm consistent with an embodiment of the present invention.
Figure 6:
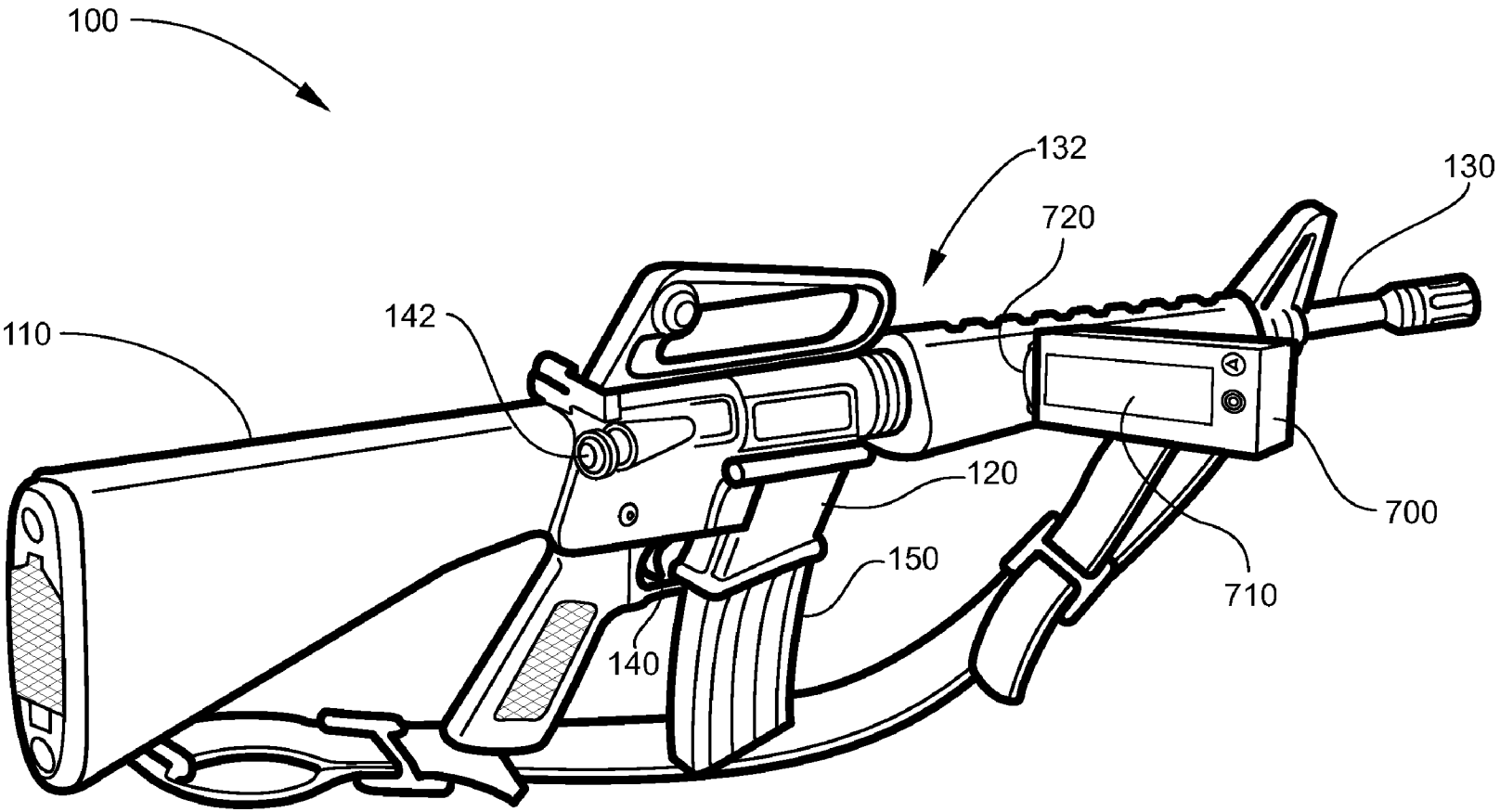
FIG. 6. is a perspective view of a firearm with a display consistent with one or more embodiments of the present invention.

Referring now to FIG. 5, there is illustrated a method of using a sensor located in a buffer tube to measure various parameters relating to the use (discharge) of a machinegun or semi-automatic firearm, consistent with an embodiment of the present invention. For efficiency, ease of explanation, and to facilitate understanding of the method, conconcurrent reference is made to FIGS. 1-3 in the description that follows. It is to be understood, however, that the method may be executed using firearms of other arrangements.

The method 500 includes the following operations: sensing, via the sensor disposed along a longitudinal axis that is the axis of the buffer tube and of travel of the piston during recoil, movement of a piston of the firearm in response to a cycling of the action of the firearm (operation 510); transferring the sensed information to a processing module (operation 520); transforming the transferred information into use information (operation 530); displaying the use information to the user of the firearm (operation 540). Additionally and/or optionally, the method 500 may include receiving an input about the use (operation 550). When method 500 includes this optional receiving operation, the transforming of operation 530 may be based on the received input.

Examples of Various Calculations

Examples of some calculations of various performance parameters are discussed, with concurrent reference to FIGS. 1-5. This concurrent reference is for efficiency, ease of explanation and to facilitate understanding of aspects of embodiment(s) of the present invention only.

Service due—Total firing count since last reset

At least one embodiment of the present invention may calculate and, optionally, indicate when service may be due on a firearm. A particular firearm typically has a need for service after a number of fired rounds exceeds a threshold. So, each firing of the firearm 100 may be counted by the processor (via sensing piston travel in the buffer tube 210 due to the cycling of the firearm) and compared to a threshold value. When the threshold value is met or exceeded, a "service due" indication may be displayed on the display.

Rounds fired since last service, maintenance, inspection or since inception

At least one embodiment of the present invention may count each cycling of the firearm 100. As explained above, at least one embodiment of the present invention counts the number of times a firearm is fired. This value may be compared to an incept condition, for example, or a most recent reset, which may be affected at the time of service, maintenance, and/or inspection.

Ammunition Count

At least one embodiment of the present invention may calculate an amount of ammunition remaining in a magazine. A size (capacity) of a magazine may be input to the system through the input section. Then, during use, each discharge and priming may be sensed and recorded. Next, with this count may be compared to the capacity of a loaded magazine to determine a difference between these two numbers. This difference represents the remaining ammunition and may be displayed on the display.

Average Rate of Fire and Warning about Rate of Fire

At least one embodiment of the present invention may count each cycling of the firearm 100, which indicates a firing of the firearm. A count of the number of times a firearm is fired may be compared to specified time and/or count values to yield various parameters relating to the firing of the firearm. For example, the count may be compared to a time value to yield an average rate of cycling (fire) according to the following formula:

$$\text{Count of Cyclings}/\text{Time}=\text{Average Rate of Cyclings} \quad (4)$$

Further, for example, the average rate of cyclings may be compared to a threshold value representing the maximum safe rate of fire for the firearm. The following is an example of a comparison formula:

$$\text{Average Rate of Cyclings} \leqq \text{Threshold Rate of Cyclings} \quad (5)$$

This comparison yields an indication of an unsafe firing condition, which may be optionally indicated to the user.

Estimated muzzle velocity and stopping force

At least one embodiment of the present invention may calculate a muzzle velocity and/or a stopping force of a round fired from a firearm. To collect information necessary for these calculation, the system may obtain an acceleration of the fired round. One way to obtain this information is with the optional barrel sensor 370 of FIG. 2, which can be used measure the time from firing to a time when the fired round passes the barrel sensor. This time, in conjunction with the distance from the loaded cartridge to the barrel sensor, can be used to compute a speed of a fired bullet using the following formula:

$$V=D/T, \quad (6)$$

where D is the distance from loaded cartridge to barrel sensor, and T is the time from cycling to when the barrel sensor detects of temperature increase. When the barrel sensor is located near the discharge end of the barrel, the calculated velocity is approximately equal to the muzzle velocity.

The stopping force of the fired bullet may be computed as using the following formulae:

$$F=M\times A, \quad (7)$$

where M is the mass of the bullet and A is the acceleration of the round. Acceleration A is calculable using the following formulae:

$$A=\text{Delta } V/T; \quad (8)$$

$$\text{Delta } V=V_{muzzle}-V_{rest}; \quad (9)$$

$$V_{rest}=0; \text{ and} \quad (10)$$

$$\text{Delta V}=V_{muzzle}, \quad (11)$$

Where Delta V is the change in velocity and $V_{muzzle}$ is the exit velocity. Then, using the formula, $$F_{stopping}=M_{round}\times(V_{muzzle}/T), \quad (12)$$

An estimated stopping force may be obtained.

In addition, the following are additional firing parameters calculable by at least one embodiment of the present invention: a round count since power on; an instantaneous rate of fire; a number of rounds remaining in a magazine; a number of rounds remaining on a person; a time at 100% rate of fire; and a time stamp and date of each round.

Non-Limiting Examples of Code

The following is a non-limiting example of code used by the processor 320 to perform various operations, including various ones of the aforementioned examples.

```
#include "header.h"
char PROGMEM top[ ]=" TOP ";
char PROGMEM mid[ ]=" MID ";
char PROGMEM bot[ ]=" BOT ";
char PROGMEM miss[ ]="*MIS*";
char PROGMEM space[ ]="   ";
char PROGMEM reseting[ ]="RESETING.....";
void send_cycles_info(uchar location, uchar data)
{
        char buffer[4];
        volatile uchar i;
        //for (i =0; i<3;i++) { buffer[i] = 32;}
        itoa((int)(data), buffer, 10);
        locate(location);
        i=0;
        while (i<3)
        {
            lcd_send_4b_mode(buffer[i]);
            i++;
            if (buffer[i] == 0)
            {
                break;
            }
        }
        /*for(i=0; i<3;i++)
        {
            if (buffer[i] == 0)
            {
                buffer[i++] = 0;
            }else{
                lcd_send_4b_mode(buffer[i]);
            }
        }*/
}
void reset( ){
    volatile uchar i;
    for (i = 0; i<RPM_HISTORY; i++)
    {
        rpm_his[i] = 0;
    }
    n_cycle_manu = 0;
    n_cycle_auto = 0;
    time_stamp = 0;
```

-continued

```
    t_pre_scale = 0;
    t_travel = 0;
    lcd_bl_timer = 0;
    format( );
}
int main(void)
{
        volatile uchar i;
        char buffer[16];
            char *p_str;
        stream[0] = 15;
        stream[1] = 51;
        LED_OFF;
    usbInit( );
        setup_timers( );
        setup_uart( );
    sei( );
        PORTB I= (1<<PB3);      //activate pull up pn PB3
        BL_DDR I= (1<<BL);      //Activate LCD backlight ouput
        DDRD I= (1<<PD3);       //Activate LED output
        LCD_DDR I= (LCD_MASK);
        LCD_EN_DDR I= (1<<LCD_EN);
        LCD_RS_DDR I= (1<<LCD_RS);
        _delay_ms(20); //wait for LCD to start up
        ini_lcd_4_bit_mode( );
        _delay_ms(1);
        cls( );
        format( );
        lcd_bl = 1; //Turn On Back light
        LCD_BL_ON; //activate PWM Fading on backlight
    while(1)
      {
        if (bit_is_clear(PINB, PB3))
        {
            reset( );
            while(bit_is_clear(PINB, PB3))
            {
                usbPoll( );
            }
        }
        if (crank_reset_counter > CRACK_RESET_CONFIRMATION_DELAY)
        {
            cls( );
            while(crank_reset_counter > CRACK_RESET_CONFIRMATION_DELAY)
            {
                usbPoll( );
                lcd_bl_timer = 0;
                locate(0);
                //show "reseting" message
                for(i = 0; i< (8+((crank_reset_counter)>>4)); i++){
                lcd_send_4b_mode(pgm_read_byte(reseting + i));
                }
                if (crank_reset_counter > CRACK_RESET_DELAY)
                {
                    reset( );
                    while(crank_reset_counter >
CRACK_RESET_CONFIRMATION_DELAY)
                    {
                        usbPoll( );
                    }
                }
            }
            format( );
        }
        if (reset_order == 1)
        {
            reset_order = 0;
            reset( );
        }
        //cycle_postition
        i++;
        usbPoll( );
        //display piston position
        locate(68);
        p_str = top;
        stream[2] = POS_TOP;
        switch(cycle_postition)
        {
            case CYCLE_TOP_MID_TOP:
                if (misfire_flag){
```

-continued

```
                    //for (i = 0; i< 5; i++){
                        p_str = miss;
                        stream[2] = POS_MISS;
                //lcd_send_4b_mode(pgm_read_byte(miss + i));
                //}
                }else{
                    //for (i = 0; i< 5; i++){
                        p_str = top;
                        stream[2] = POS_TOP;
                //lcd_send_4b_mode(pgm_read_byte(top + i));
                //}
                }
            break;
            case CYCLE_TOP:
                //for (i = 0; i< 5; i++){
                    p_str = top;
                    stream[2] = POS_TOP;
            //lcd_send_4b_mode(pgm_read_byte(top + i));
            //}
            break;
            case CYCLE_TOP_MID:
            case CYCLE_BOT_MID:
            case CYCLE_MID_TOP_MID:
            case CYCLE_MID_BOT_MID:
                //for (i = 0; i< 5; i++){
        // lcd_send_4b_mode(pgm_read_byte(mid + i));
            //}
                p_str = mid;
                stream[2] = POS_MID;
            break;
            case CYCLE_BOT:
            case CYCLE_BOT_MID_BOT:
                //for (i = 0; i< 5; i++){
        // lcd_send_4b_mode(pgm_read_byte(bot + i));
            //}
                p_str = bot;
                stream[2] = POS_BOT;
            break;
            default:
            break;
        }
        for (i = 0; i< 5; i++){
        lcd_send_4b_mode(pgm_read_byte(p_str + i));
        }
        //Display Manual cycles
        send_cycles_info(77,n_cycle_manu);
        stream[3] = n_cycle_manu;
        stream[4] = (n_cycle_manu>>8);
        //Display automatic cycles
        send_cycles_info(13,n_cycle_auto);
        stream[5] = n_cycle_auto;
        stream[6] = (n_cycle_auto>>8);
        //Calculate average RPM
        avg_rpm = 0;
        for (i = 0; i<RPM_HISTORY; i++)
        {
            avg_rpm += ((double)60000/((double)rpm_his[i]));
    //result is multiplied by ten, to include the first decimal. Decimal point is
added manually later
        }
        avg_rpm = avg_rpm / RPM_HISTORY;
        avg_rpm = avg_rpm * CORRECTION_FACTOR;
        //avg_rpm = (rpm_his[rpm_his_counter−1]);
        disp_rpm = avg_rpm;
        stream[7] = disp_rpm;
        stream[8] = (disp_rpm>>8);
        //disp_rpm = top_mid_detail;
        //disp_rpm = 9;
        itoa((int)(disp_rpm), buffer, 10);
        locate(4);
        i=0;
        while (1)
        {
            lcd_send_4b_mode(buffer[i]);
            i++ ;
            if (buffer[i] == 0)
            {
                break;
            }
            i++ ;
```

-continued

```
                if (buffer[i] == 0)
                {
                    break;
                }
                i--;
            }
            //display one digit after decimal point.
            locate(3+i);
            if( disp_rpm < 10)
            {
                lcd_send_4b_mode('0');
            }
            lcd_send_4b_mode('.');
            lcd_send_4b_mode(buffer[i-1]);
            while (i<4)
            {
                lcd_send_4b_mode(' ');
                i++;
            }
            LED_ON;
        } //end of While (1)
        return 0;
}
```

The code may be USB software updateable.

The following is a non-limiting example of code used by the processor 320 to monitor when a round exits the barrel, in conjunction with a barrel sensor 370.

```
// ISRs
#include "header.h"
ISR(TIMER0_COMPA_vect,ISR_NOBLOCK)
{
    //DDRD I= (1<<PD3);
    //PORTD I= (1<<PD3);
    t_pre_scale++;
    //Executed at 1001.6025 Hz, or every 0.9984 mS
    if (t_pre_scale > 10)
    {
        t_pre_scale = 0;
        if (time_stamp < 65000)
        {
            time_stamp++; //Used to calculate time between two cycles
        }
        if ((crank_reset_flag==1)&(crank_reset_counter < 60000))
        {
            crank_reset_counter++;
        }
        if (lcd_bl_timer < 60000)
        {
            lcd_bl_timer++;
            if (lcd_bl_timer > 1000) //wait 10 seconds without cycles to shut down LCD
BL
            {
                lcd_bl = 0;
            }else{
                lcd_bl = 1; //Turn On Back light
                LCD_BL_ON; //activate PWM Fading on backlight
            }
        }
    }
    if (t_travel < 65000)
    {
        t_travel++; //Travel time : time between when the piston leaves the top position
and when it it reaches back the top position.
                                    //In other words, t_travel counts all the time not spent in the top
position
    }
    //PORTD &= ~(1<<PD3);
    //LCD facklight fadings
    if (lcd_bl == 1)
    {
        if (OCR1B < 250){ OCR1B += 1;}
    }else{
        if (OCR1B > 10)
```

-continued

```
            {
                OCR1B -= 1;
            }else{
                LCD_BL_OFF;
            }
        }
        if (bit_is_set(UCSR0A,RXC0))
        {
            soft_uart_isr(UDR0);
        }
}
//ISR(USART_RX_vect,ISR_NOBLOCK)
void soft_uart_isr(uchar uart_data)
{
        uchar i;
/* uart_data = UDR0;
        if ((uart_data >> 6) == UART_CYCLE_INFO) // if the data sent by the sensor is not
the last byte
        {
            cycle_postition = uart_data & (~(3<<6)); //store data for later use
            while(bit_is_clear(UCSR0A,RXC0)); //wait for next byte
            top_mid_detail = UDR0 & (~(3<<6));
        }*/
            if ((uart_data >> 6) == UART_CYCLE_INFO) // if the data sent by the sensor
concerns cycle information
            {
                cycle_postition = uart_data & (~(3<<6));
                stream[0] = cycle_postition;
                switch(cycle_postition)
                {
                    case CYCLE_TOP:
                        if (bottom_flag) //if the piston comes up after being at the bottom
                        {
                            bottom_flag = 0; //reset botom flag
                            lcd_bl_timer = 0;
                            //count a cycle, but first detect if it's AUTOMATIC or MANUAL using
t_travel
                            if(t_travel <= AUTO_CYCLE_MAX_TIME)
                            {
                                //*** Automatic cycle detected ***
                                //in case this shot is one of the first ones, fill the table with the
same value
                                if (n_cycle_auto == 0)
                                {
                                    for (i = 0; i<RPM_HISTORY; i++)
                                    {
                                        rpm_his[i] = time_stamp;
                                    }
                                }
                                n_cycle_auto++;
                                //A valid TOP-MID-BOTTOM-MID-TOP cycle is detected, gather cycle
time data for RPM calculations:
                                rpm_his[rpm_his_counter] = time_stamp;
                                time_stamp = 0;
                                t_pre_scale = 0;
                                rpm_his_counter++;
                                if (rpm_his_counter >= RPM_HISTORY){ rpm_his_counter = 0; }
                            }else{
                                //Manual cycle detection
                                n_cycle_manu++;
                            }
                        }
                        t_travel = 0; //reset the travel time counter, after it has been processed in
the above code
                    break;
                    case CYCLE_TOP_MID_TOP: //Try to detect a missfire
                        if (middle_flag) //if the piston comes up after being at the bottom
                        {
                            middle_flag = 0;
                            if (t_travel <= AUTO_CYCLE_MAX_TIME)
                            {
                                misfire_flag = 1;
                            }
                        }
                        t_travel = 0; //reset the travel time counter, after it has be processed in
the above code
                    break;
                    case CYCLE_MID_TOP_MID:
                    case CYCLE_TOP_MID:
                        middle_flag = 1; //confirm that middle of cylinder reached.
```

-continued

```
                misfire_flag = 0;
                ignore_crank_reset_flag = 1;
            break;
            case CYCLE_BOT:
                misfire_flag = 0;
                bottom_flag = 1; //confirm that botom of cylinder reached.
                ignore_crank_reset_flag = 1;
            break;
            default:
            break;
        }
    }else if((uart_data >> 6) == UART_TOP_MID_DETAIL){
        top_mid_detail = uart_data & (~(3<<6));
        stream[1] = top_mid_detail;
        if ((top_mid_detail >= CRANK_RESET_LIMIT))
        {
            if (ignore_crank_reset_flag == 0)
            {
                crank_reset_flag = 1;
            }else{
                crank_reset_counter = 0;
                crank_reset_flag = 0;
            }
        }else{ //The piston is back to the top
            crank_reset_counter = 0;
            ignore_crank_reset_flag = 0;
            crank_reset_flag = 0;
        }
    }
}
```

As the aforementioned processor code shows, the sensor 310 sends piston 212 position information to the processor 320. At a rate of 300 times per second, for example, the infrared sender and receiver 420 may optically scan the position of the piston inside the buffer tube. When the buffer 212 is moving, there can only be three reasons (the firearm is normally discharged, the firearm has misfired, or the charging lever has been manually pulled back). Normal outside shock is insufficient to significantly shift the piston position because it is held in place under constant spring pressure.

The optical sensor determines whether the piston 212 is in the top, middle, or bottom position. It remembers the path the buffer is traveling in and the amount of time it took to travel that path.

For example, if the piston travels top-middle-bottom-middle-top in typically less than 250 ms, then it's considered a normal firearm discharge. If the time to go from top-middle-bottom-middle-top takes longer than 250 ms than it is registered as normal hand cranking of the charging handle. If it only travels from Top-Mid-Top in less than 250 ms than that's registered as an incomplete discharge or a misfire. With this determination, the processor may indicate that there is potentially a bullet stuck in the barrel.

Example of Operation

The operation of a non-limiting example of an embodiment using a low power infrared (IR) light is discussed.

An IR emitter/receiver pair is positioned at the bottom of the cylinder. The IR beam is emitted by a standard IR-LED with a narrow 25° radiation angle. The receiver is a phototransistor, with a peak excitation bandwidth that may match the bandwidth of the emitted IR.

The emitter sends IR light directed to the piston, and the receiver measures the intensity of the reflected IR light from the piston.

Since the environment in which the distance (position) measurement is made has quasi-constant optical parameters (like ambient light intensity and surface finish and color of the walls of the cylinder), the position of the piston may be considered based on the proportion of the reflected IR light to the emitted light.

In order to optimize the functioning of the measurement system, prior to sending any IR light and measuring its reflection, a 'blank' measurement is made. This 'blank' measurement consists of recording the output value of the phototransistor stage without having any IR light directed to it. The result of this measurement is considered the dc noise bias. Then, the IR LED is activated, and after approximately 150 us (for the phototransistor to stabilize) the reflected IR light intensity is measured.

A noise-free measure is then obtained by subtracting the dc noise level measured earlier, from the value measured from the phototransistor output stage.

This is repeated for every measurement, and thus allows very efficient adaptation to any kind of perturbations.

In order to gather and send precise information to the display system at a fairly high rate without overloading its processor, a first data compression is made in the micro controller embedded in the IR sensor.

The IR sensor's embedded controller converts the brute data obtained from the phototransistor to a very low resolution variable that may hold information such as whether the piston is at TOP, MIDDLE or BOTTOM position. Then the last three positions maybe encoded into one byte (8-bit) variable, and may be transmitted to the processor via a standard serial data transfer protocol like the UART.

That encoded variable contains enough information for the processor to resolve the "history" of movement of the piston rather than an instantaneous position. For instance, if the piston is at the top position, this encoded variable will let the computer know whether the piston comes from the bottom of the cylinder, passing via the middle, or if the piston simply had a slight displacement from the top position, to the middle, and back to the top without passing through the bottom of the cylinder.

One important benefit of the encoding of the last three positions into one variable is that it also allows the display system to easily detect and ignore erroneous sensor readings (e.g., TOP-BOTTOM-TOP is an erroneous reading since the sensor had to pass through the MIDDLE position).

In order to allow greater flexibility over the installation of the system and its working environment, a calibration functionality has been developed to allow the sensor to change the delimiting values at which it considers the piston at the top, middle or at the bottom of the cylinder. Needless to say, this can greatly affect the overall functioning of the system and is considered as a security factor for the end user in case one of the parts related to the sensor is exchanged with a different one.

The display module has, among others, the function to carry all timing related calculations. An internal 1 ms second timer module allows precise time calculations for "time of cycle". The "time of cycle" is the time elapsed between when the piston leaves the top position and when it returns to that same position. This value is also used to differentiate between manual and automatic cycles. If the 'time of cycle' is less than 250 ms, the computer considers that an automatic cycles has occurred.

As described above, embodiment(s) of the present invention provide various novel arrangements and approaches to measure the position and velocity of a piston inside a buffer of a machinegun or semi-automatic rifle. And, with such information, various parameters relating to the discharge of the firearm may be calculated and conveniently displayed to a user. Such information may increase the utility and safety of the user.

In addition, embodiment(s) of the present invention display(s) the current buffer position for the firearm without having to turn the rifle to look through the ejection port or to guess based on a perceived weight shift. Instead, advantageously, an indication of whether the buffer is open, closed or semi-closed (i.e., jammed) is communicated to an operator during use, while the operator keeps the firearm sighted and in firing position.

In addition, embodiment(s) of the present invention, when a high-speed optical sensor is used as the buffer tube sensor 310, avoid many of the deficiencies of conventional round counters, which are binary in nature with dual sensors. We only have one sensor. A high-speed optical sensor can enable a processor to calculate instantaneous speed and position continuously and energy-efficiently. In contrast, existing designs are burdened by multi-sensor complexity.

All examples described and/or illustrated herein are intended to be non-limiting examples.

In the event that more than one embodiment has been described, it is to be understood that such embodiments are not discrete and separate. Rather, unless stated otherwise, the embodiments are selectively combinable.

Although one or more selected embodiment(s) of the present invention have been shown and described, it is to be understood the present invention is not limited to the described embodiment(s). Instead, it is to be appreciated that changes may be made to these embodiment(s) without departing from the principles and spirit of the invention, the scope of which is defined by the claims and the equivalents thereof.

What is claimed is:

1. A system for resolving at least one use parameter relating to a firing of a machinegun or of a semi-automatic firearm having a receiver, an action within the receiver and that includes a piston, and a buffer tube that receives at least a portion of the piston during a cycling of the action in response to a recoil, comprising:

a display configured to display at least an indication of at least one use parameter;

a sensor disposed in the buffer tube, the sensor sensing a cycling of an action via movement of the piston in the buffer tube;

a processor that receives sensed data from the sensor and, based on the received sensed data, calculates the at least one use parameter, the processor causing the display to display the at least an indication; and a power source disposed in the stock or the display and energizing the sensor, the processor, and the display.

2. The system of claim 1, further comprising an electronic storage that stores information from, and under the control of, the processor.

3. The system of claim 1, further comprising an electronic storage that stores sensed data.

4. The system of claim 1, further comprising an input section that receives user input usable to calculate the at least one use parameter.

5. The system of claim 1, wherein the at least one use parameter is a total number of cyclings of the action and the system further comprises a reset section that resets a count of a number of cyclings of the action.

6. The system of claim 1, wherein the at least one parameter is a number of rounds in a magazine loaded in the firearm and the processor causes the display to display the number, unless the number is less than a specified threshold.

7. The system of claim 1, further comprising a barrel sensor disposed in the barrel of the firearm, that senses the passing of a fired round, wherein the at least one parameter is stopping force, and wherein the stopping force is calculated by the processor based on sensed data from both sensors.

8. The system of claim 1, wherein the processor is remote from the firearm and receives the sensed data via a wireless connection.

9. The system of claim 1, wherein the sensor is a piezoelectric sensor that senses movement based on spring compression.

10. The system of claim 1, wherein the sensor is a photoelectric sensor.

11. The system of claim 1, wherein the sensor is a magnetic sensor that senses movement of the piston based on changes in a magnetic field caused by the movement.

12. The system of claim 1, wherein the sensor is an infrared (IR) sensor including an IR-LED that transmits an IR signal and a phototransistor that receives a reflected IR signal, the sensor being (i) disposed in the buffer tube at an end distal to the piston, (ii) arranged to transmit the IR signal toward the piston, and (iii) receive the reflected IR signal from the piston.

13. The system of claim 12, wherein the sensor includes an embedded controller that converts data obtained from the phototransistor to a low resolution variable that indicates whether the piston is at TOP, MIDDLE or BOTTOM position.

14. The system of claim 13, wherein the last three positions of the piston are encoded into a one byte variable and transmitted to the processor, the encoded variable containing enough information for the processor to resolve a history of movement of the piston rather than an instantaneous position.

15. The system of claim 1, wherein the system takes a "zeroing" or "blank" measurement before each measurement of the piston location.

16. A stock for a firearm of an automatic or semi-automatic type, comprising:

a buffer tube that is removably attached to a receiver of the firearm and dimensioned to receive a piston that travels in the buffer tube during a recoil caused by a discharge of the firearm;

a sensor that is removably attached to the stock and that, when attached to the stock, extends into the buffer tube axially along a central axis thereof, the sensor sensing at least one parameter related to movement of the piston when the piston recoils into the buffer tube due to a discharge of the firearm;

a processor that receives sensing data from the sensor and, based on the received sensing data, calculates the at least one use parameter related to the at least one parameter, the processor causing a display to display at least an indication of the calculated at least one use parameter; and a power source that is disposed in the stock and energizes the sensor and the processor.

17. The stock of claim 16, wherein the buffer tube further comprises a spring that is compressed by the piston during recoil, wherein the piston and the attached sensor share a same longitudinal axis, and wherein the sensor is configured and disposed so as to extend into the spring.

18. A method of using a sensor located in a buffer tube of a machinegun or of a semi-automatic firearm to measure various parameters relating to the discharge of the firearm, comprising:

sensing movement of a piston of the firearm in response to a cycling of the action of the firearm, via a sensor disposed along a central, longitudinal axis of the buffer tube and of travel of the piston during recoil;

transferring the sensed information to a processing module;

transforming, via the processing module, the transferred information into use information; and displaying the use information to the user of the firearm.

19. The method of claim 18, further comprising receiving an input about the use and the transforming is based on the received input.

* * * * *